US005285759A

United States Patent [19]

Terada et al.

[11] Patent Number: 5,285,759

[45] Date of Patent: Feb. 15, 1994

[54] FUEL SYSTEM

[75] Inventors: Takehiko Terada; Hirotada Yamada; Masao Yonekawa, all of Kariya, Japan

[73] Assignee: Nippondenso Co., Ltd., Kariya, Japan

[21] Appl. No.: 982,943

[22] Filed: Nov. 30, 1992

[30] Foreign Application Priority Data

Dec. 4, 1991 [JP] Japan ..... 3-320718

[51] Int. Cl.[5] ..... F02M 37/00

[52] U.S. Cl. ..... 123/514; 137/569

[58] Field of Search ..... 123/514, 456, 459, 463; 251/205, 118, 121, 122; 137/535, 569

[56] References Cited

U.S. PATENT DOCUMENTS

| | | | |
|---|---|---|---|
| 1,791,012 | 2/1931 | Ray | 137/569 |
| 1,807,594 | 6/1931 | Hopkins | 135/535 |
| 2,557,334 | 6/1951 | Zwack | 137/569 |
| 4,279,232 | 7/1981 | Schuster et al. | 123/514 |
| 4,502,450 | 3/1985 | Duprez | 123/514 |
| 4,503,885 | 3/1985 | Hall | 137/569 |
| 4,625,701 | 12/1986 | Bartlett et al. | 123/514 |
| 4,635,606 | 1/1987 | Koike et al. | 123/459 |
| 4,732,131 | 3/1988 | Hensel | 123/514 |
| 4,838,307 | 6/1989 | Sasaki et al. | 123/514 |
| 4,911,134 | 3/1990 | Olsson | 123/514 |
| 4,926,829 | 5/1990 | Tuckey | 123/514 |
| 5,027,919 | 7/1991 | Silva et al. | 251/122 |
| 5,050,567 | 9/1991 | Suzuki | 123/514 |
| 5,085,198 | 2/1992 | Bartlett et al. | 123/514 |
| 5,146,901 | 9/1992 | Jones | 123/514 |

FOREIGN PATENT DOCUMENTS

| | | | |
|---|---|---|---|
| 0132060 | 7/1985 | Japan | 123/514 |
| 61-36139 | 3/1986 | Japan . | |
| 61-101660 | 5/1986 | Japan . | |
| 0268940 | 11/1988 | Japan | 123/514 |

*Primary Examiner*—E. Rollins Cross
*Assistant Examiner*—Thomas Moulis
*Attorney, Agent, or Firm*—Cushman, Darby & Cushman

[57] ABSTRACT

A fuel system of an internal combustion engine comprises a fuel tank for storing fuel, a fuel injection valve disposed on the internal combustion engine, a fuel supply pipeline connecting between the fuel tank and the fuel injection valve, a fuel pump for supplying the fuel in the fuel tank to the fuel injection valve through the fuel supply pipeline, a fuel injection pressure regulator for regulating the fuel injection pressure of the fuel injection valve to a predetermined pressure, a fuel return pipeline through which surplus fuel from the fuel injection pressure regulator is returned into the fuel tank, and a pressure increasing device disposed in the fuel return pipeline and serving to increase the pressure in the fuel return pipeline above the pressure in the fuel tank while maintaining fuel pressure regulating function of the fuel injection pressure regulator.

5 Claims, 4 Drawing Sheets

FUEL SYSTEM

BACKGROUND OF THE INVENTION

The present invention relates to a fuel system which serves to supply fuel stored in a fuel tank to a fuel injection valve through a fuel supply pipeline by means of a fuel pump and to return surplus fuel from a fuel injection pressure regulator serving to regulate the fuel injection pressure of the fuel injection valve to a specified pressure to the fuel tank through a fuel return pipeline.

In general, the fuel system of an internal combustion engine comprises a fuel tank, a fuel pump, a fuel injection valve and a fuel injection pressure regulator, so as to serve to supply fuel to the fuel injection valve through a fuel supply pipeline and to return surplus fuel from the fuel injection pressure regulator to the fuel tank through a fuel return pipeline.

In this kind of fuel system, owing to evaporation from the surface of fuel stored in the fuel tank or owing to abrupt change of fuel pressure caused by the fuel injection pressure regulator, fuel vapor is generated. For this reason, there is provided in an automobile such an apparatus or the like that controls exhaust of the fuel vapor by adsorbing the generated fuel vapor on activated carbon.

However, the fuel vapor leaks out in some cases to cause air pollution. To cope with this, it has been considered to restrain generation of fuel vapor itself, but there are the following problems.

In order to reduce the fuel vapor generated by evaporation, a fuel cooling system disclosed in for example Japanese Patent Unexamined Publication No. 61-101660 can be used. However, the fuel vapor resulting from abrupt reduction of pressure (overshoot) is generated with deaeration phenomenon, so that it is not so influenced by the temperature and, hence, the fuel cooling system described above has little reducing effect. Further, there has not been proposed means for reducing fuel vapor by preventing such deaeration phenomenon.

Japanese Utility Model Unexamined Publication No. 61-36139 discloses a technique for controlling the pressure of fuel which is returned from a fuel injection valve to a fuel tank. However, in a fuel pressure regulating device disclosed in this publication, the set pressure of a fuel injection pressure regulator is changed to improve the restarting ability of an engine. Therefore, even by making use of such device, the same overshoot as described above is caused to fail to reduce the fuel vapor effectively.

An object of the present invention is to provide a fuel system which is capable of reducing fuel vapor effectively.

SUMMARY OF THE INVENTION

A fuel system of an internal combustion engine according to the present invention comprises a fuel tank for storing fuel, a fuel injection valve disposed on the internal combustion engine, a fuel supply pipeline connecting between the fuel tank and the fuel injection valve, a fuel pump for supplying the fuel in the fuel tank to the fuel injection valve through the fuel supply pipeline, a fuel injection pressure regulator for regulating the fuel injection pressure of the fuel injection valve to a predetermined pressure, a fuel return pipeline through which surplus fuel from the fuel injection pressure regulator is returned into the fuel tank, and pressure increasing means disposed in the fuel return pipeline for serving to increase the pressure in the fuel return pipeline above the pressure in the fuel tank while maintaining fuel pressure regulating function to the fuel injection pressure regulator.

The pressure increase value of the pressure increasing means is set to be greater than the minimum value of overshoot of fuel pressure caused by the fuel injection pressure regulator.

The pressure increasing means can comprise a mechanical fixed choke which serves to gradually throttle return fuel flowing from the fuel injection pressure regulator.

A diameter of the choke is set to be larger than a diameter that allows the pressure in the fuel return pipeline to become equal to the fuel injection set pressure of the fuel injection pressure regulator when the fuel injection pressure regulator is at the maximum flow rate of return fuel of the internal combustion engine.

The pressure increasing means can comprise a mechanical variable choke.

The mechanical variable choke comprises an inlet portion which is to be connected to the fuel injection pressure regulator side, a movable core facing to the inlet portion, a guide member for guiding the movable core, a spring for biasing the movable core toward the inlet portion, and an outlet portion which is to be connected to the fuel tank side, and a portion where an area of passage defined between the movable core and the inlet portion is the narrowest serves as a choke portion and the passage area is changed smoothly before and after passing the choke portion.

The mechanical variable choke comprises an inlet portion which is to be connected to the fuel injection pressure regulator side, an outlet portion which is to be connected to the fuel tank side, a movable core facing to the outlet portion, a spring for biasing the movable core toward the outlet portion, and a diaphragm to which the movable core is connected and which serves to move the movable core away from the outlet portion until the pressure of return fuel flowing from the fuel injection pressure regulator and the set pressure of the spring are balanced, and a portion where an area of passage defined between the movable core and the outlet portion is the narrowest serves as a choke portion and the passage area is changed smoothly before and after passing the choke portion.

In the fuel system of the present invention having the above-described construction, the pressure of fuel in the fuel return pipeline is increased above the pressure in the fuel tank, and therefore, no deaeration phenomenon takes place, thereby making it possible to prevent generation of fuel vapor.

DESCRIPTION OF THE PREFERRED EMBODIMENTS

Description will be given below of preferred embodiments of the present invention with reference to the drawings.

Figure 1:
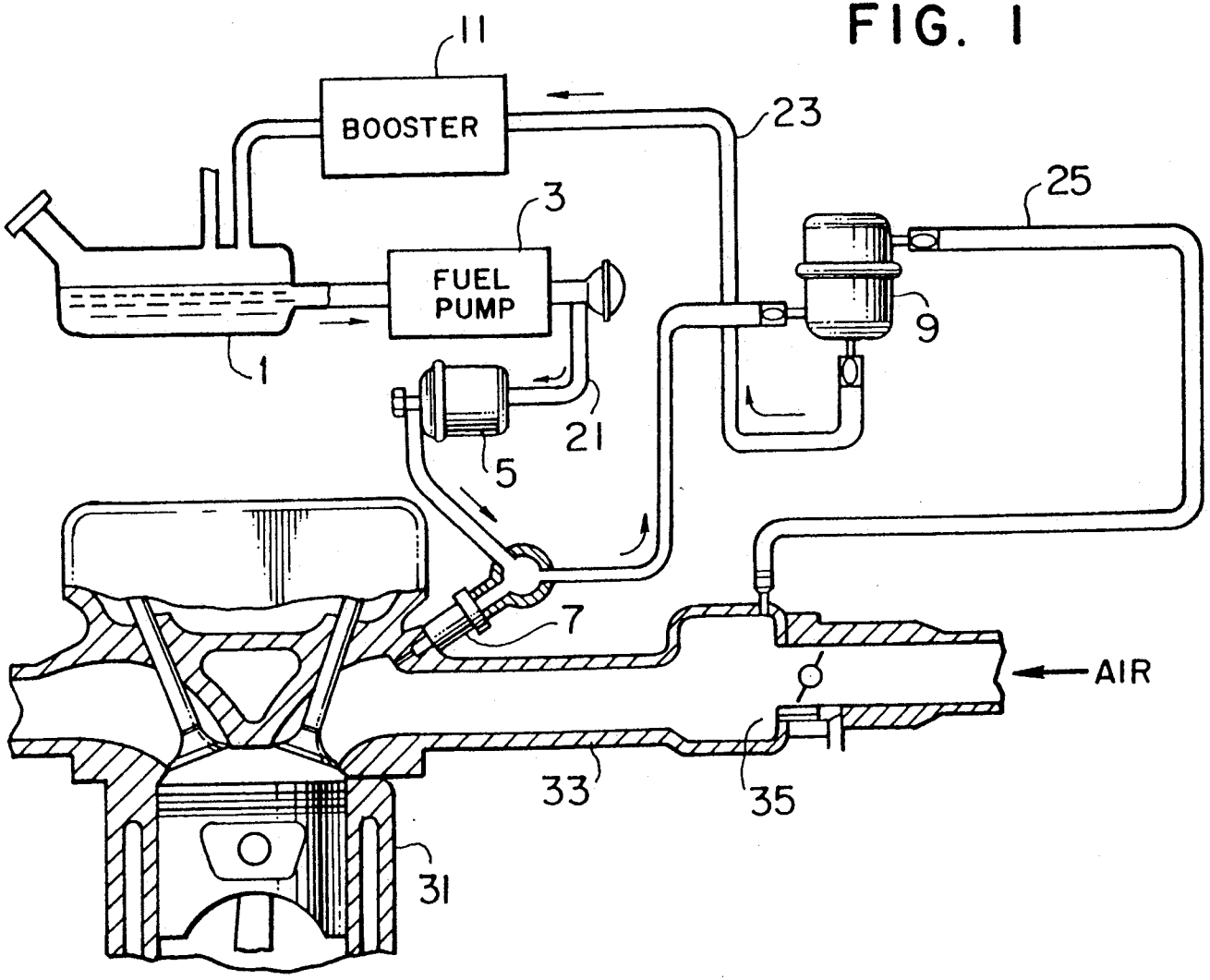
FIG. 1 is an explanatory view for illustrating a fuel system according to the present invention.

In FIG. 1, a fuel system comprises a fuel tank 1, a fuel pump 3 for drawing fuel from the fuel tank 1 and feeding it under pressure, a fuel supply pipeline 21 through which the fuel being fed under pressure is supplied to an engine 31, a filter 5 serving to remove water and the like from the fuel, a fuel injection valve 7 serving to inject the fuel into the engine 31, a fuel injection pressure regulator (referred to as pressure regulator hereinafter) 9 for regulating the fuel injection pressure of the fuel injection valve to a predetermined pressure, a fuel return pipeline 23 through which surplus fuel is returned from the pressure regulator 9 to the fuel tank 1, and a booster 11 serving to increase the pressure of fuel in the fuel return pipeline 23 leading from the pressure regulator 9 to the fuel tank 1 (referred to as return fuel hereinafter) above the pressure in the fuel tank 1.

Figure 2:
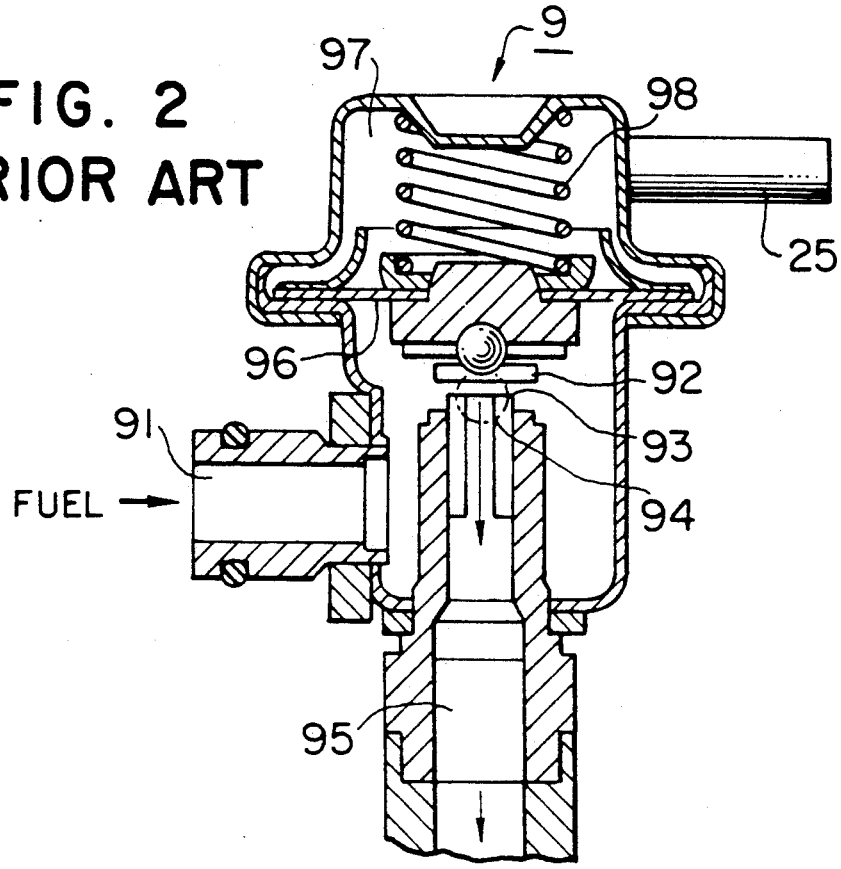
FIG. 2 PRIOR ART
FIG. 2 is a sectional view for illustrating the internal structure of a pressure regulator used in the fuel system of this embodiment.

Referring to FIG. 2, the pressure regulator 9 comprises an inlet portion 91 through which the fuel coming from the fuel injection valve 7 side is introduced, a pressure regulating portion 94 including a valve body 92 and a valve seat 93 for regulating the pressure of the fuel on the inlet portion 91 side, an outlet portion 95 connected to the fuel return pipeline 23, a diaphragm 96, a back pressure chamber 97 isolated from the fuel flow passage by the diaphragm 96, and a spring 98. The back pressure chamber 97 is connected to a surge tank 35 through a pipeline 25 as shown in FIG. 1 so that the negative pressure in an intake pipe 33 is introduced into the back pressure chamber 97. The fuel pressure at the inlet portion 91, that is, the fuel injection pressure of the fuel injection valve 7 is kept at a value which is higher than the pressure in the back pressure chamber 97 or the negative pressure in the intake pipe 33 by the set pressure of the spring 98.

Figure 3:
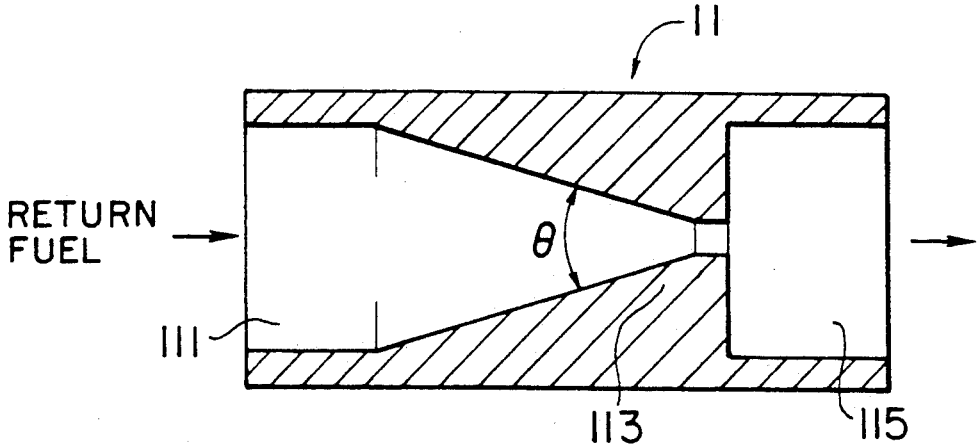
FIG. 3 is a sectional view for illustrating an example of structure of a booster used in the fuel system of this embodiment.

FIG. 3 shows an example of structure of the booster 11. The booster 11 comprises an inlet portion 111 which is to be connected to the pressure regulator 9 side, a choke portion 113 serving to gradually throttle the return fuel flowing from the pressure regulator 9, and an outlet portion 115 which is to be connected to the fuel tank 1 side. The choke portion 113 functions to keep the fuel pressure on the upstream side thereof that ranges from the pressure regulating portion 94 of the pressure regulator 9 to the inlet portion 111 higher than the pressure in the fuel tank 1 as well as to make the pressure at the inlet portion 111 gradually decrease to the fuel pressure at the outlet portion 115 on the downstream side, that is, to the pressure in the fuel tank 1. In order to prevent the pressure from being changed abruptly in the choke portion 113 as described above, the angle $\theta$ of the choke portion 113 is selected to be a gentle angle such as 5°.

In FIGS. 1 to 3, the flow of fuel is shown by arrows. As shown in FIG. 1, the fuel is drawn from the fuel tank 1 by means of the fuel pump 3 and supplied through the fuel supply pipeline 21 and the filter 5 to the fuel injection valve 7 and further to the engine 31 by means of the fuel injection valve 7. Surplus fuel is sent from the fuel injection valve 7 to the pressure regulator 9. In the pressure regulator 9, the fuel is introduced from the inlet portion 91, passed through the pressure regulating portion 94 and sent out through the outlet portion 95 to the fuel return pipeline 23. Then, the fuel is passed through the choke portion 113 of the booster 11 disposed in the fuel return pipeline 23 and returned to the fuel tank 1.

Figure 4:
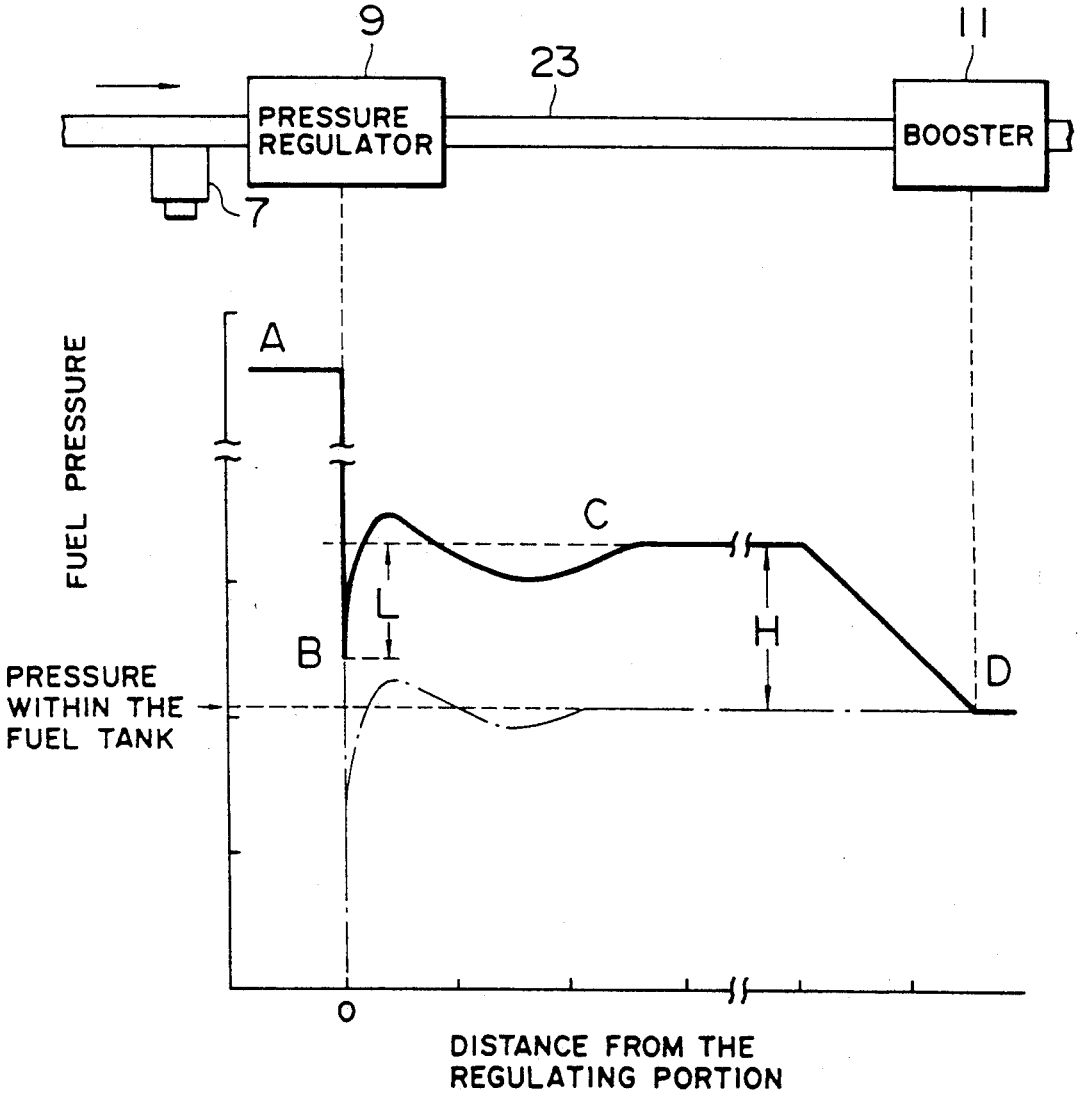
FIG. 4 is an explanatory view for illustrating the pressure of return fuel in a fuel return pipeline leading from the pressure regulator to a fuel tank via the booster.

FIG. 4 shows the pressure of return fuel in the fuel return pipeline 23 leading from the pressure regulator 9 to the fuel tank 1 via the booster 1.

On the inlet portion 91 side of the pressure regulator 9, the fuel pressure is kept at a predetermined fuel injection pressure (of level A shown in FIG. 4). When the fuel passed through the pressure regulating portion 94 of the pressure regulator 9, since the cross-sectional area of the flow passage is reduced suddenly the flow rate of the fuel is increased rapidly at this portion, resulting in that the pressure is reduced abruptly (at pressure reducing point B shown in FIG. 4). This abrupt reduction of pressure is referred to as overshoot. In this embodiment, the pressure of the return fuel is increased by the booster 11 so that the minimum pressure attributable to overshoot is kept higher than the pressure in the fuel tank 1. After passing through the pressure regulating portion 94, the pressure of the fuel is increased to a predetermined level (or level C shown in FIG. 4) and then returned to the pressure in the fuel tank 1 (of level D shown in FIG. 4) as the fuel passes through the choke portion 113 of the booster 11.

It is noted that, since the choke portion 113 of the booster 11 is so designed as to gradually throttle the fuel, the fuel pressure is decreased gradually in proportion as the fuel flows, so that overshoot never occur at the booster 11.

In FIG. 4, one-dot chain line shows the fuel pressure in a conventional fuel system in which the booster 11 is not provided. The fuel pressure decreases abruptly at the pressure regulating portion 94 and is then recovered to the pressure in the fuel tank 1. At this time, in the pressure regulating portion 94, the fuel pressure is lowered below the pressure in the fuel tank 1.

Fuel of the internal combustion engine, e.g., gasoline, is a mixture of various kinds of hydrocarbons. These hydrocarbons comprise ones from low to high volatility and there are some hydrocarbons which are dissolved therein under an ordinary pressure and ordinary temperature notwithstanding that they are in gas phase essentially. For example, butane and propane are contained in gasoline in fair amount though their boiling points are below 0° C. As the pressure of fuel is reduced less than the pressure in the fuel tank 1, the components which are in gas phase essentially but dissolved in gasoline are supersaturated and separated as fuel vapor. This is referred to as deaeration phenomenon.

As described above, in the conventional fuel system, the fuel pressure is reduced less than the pressure in the fuel tank 1 owing to overshoot of the fuel pressure, thereby generating fuel vapor due to deaeration phenomenon. However, in the present embodiment, the pressure of return fuel is increased by the booster 11 so that the fuel pressure is prevented from being less than the pressure in the fuel tank 1 even when overshoot takes place in the pressure regulator 9. In consequence, there is no possibility that the components which are in gas phase essentially are separated due to deaeration, thereby making it possible to prevent generation of fuel vapor from the fuel returned to the fuel tank 1.

Next, description will be given of the required value of the diameter of the choke portion 113 of the booster 11. In this embodiment, since the choke portion 113 is fixed one, as the flow rate of the return fuel is changed the degree of increase of the return fuel pressure attributable to the booster 11 (pressure increase value H by the booster shown in FIG. 4) is changed. If this value becomes smaller than the minimum value of overshoot of the fuel pressure by the pressure regulator 9 (pressure drop value L shown in FIG. 4), the effect of preventing fuel vapor generation is deteriorated. Therefore, it is necessary that the pressure increase value H by the booster 11 is so set as to always exceed the drop value L.

The increase value H is minimized when the flow rate of the return fuel is the smallest. The return flow rate depends on the discharge amount of the fuel pump 3, the injection amount of the fuel injection valve 7 and the like, and is peculiar to each kind of internal combustion engine. In consequence, it is necessary to make the diameter of the choke portion 113 smaller than a diameter that allows the increase value H and the drop value L to become equal to each other when the return flow rate of the internal combustion engine is the smallest.

Further, if the increase value H becomes too large, the function of regulating the fuel injection pressure of the pressure regulator 9 is hindered. Therefore, it is necessary to make the diameter of the choke portion 113 larger than a diameter that allows the pressure in the fuel return pipeline 23 to become equal to the fuel injection set pressure when the flow rate of return fuel of the internal combustion engine is the largest. The diameter which satisfies the above two conditions is the required diameter of the choke portion 113. The booster 11 is not limited in form to the one shown in FIG. 3 provided that the aforesaid two conditions are satisfied. Further, the fixed choke of this embodiment can be replaced by variable choke.

Figure 5:
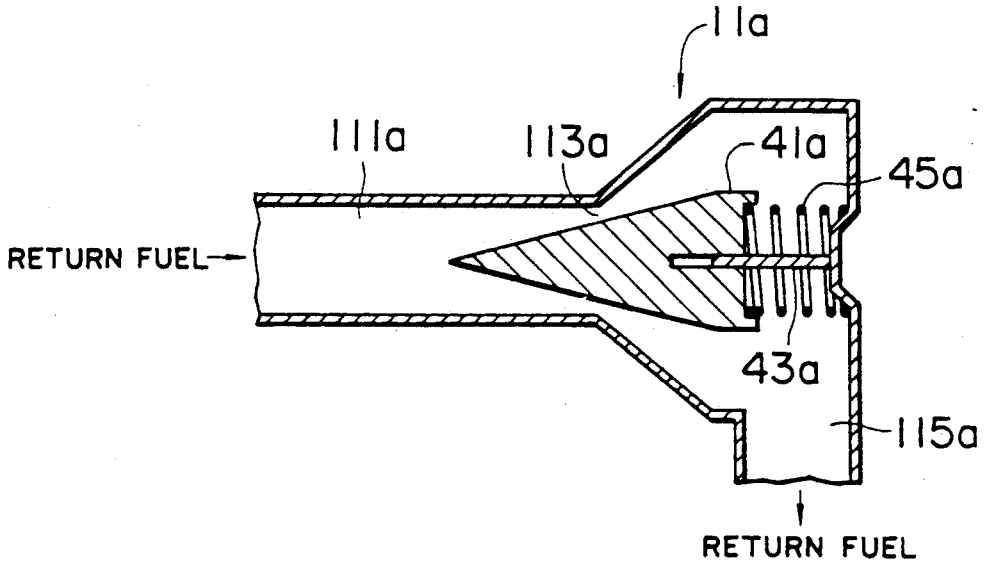
FIG. 5 is a sectional view for illustrating an example of booster the type of which is different from that shown in FIG. 3.
Figure 6:
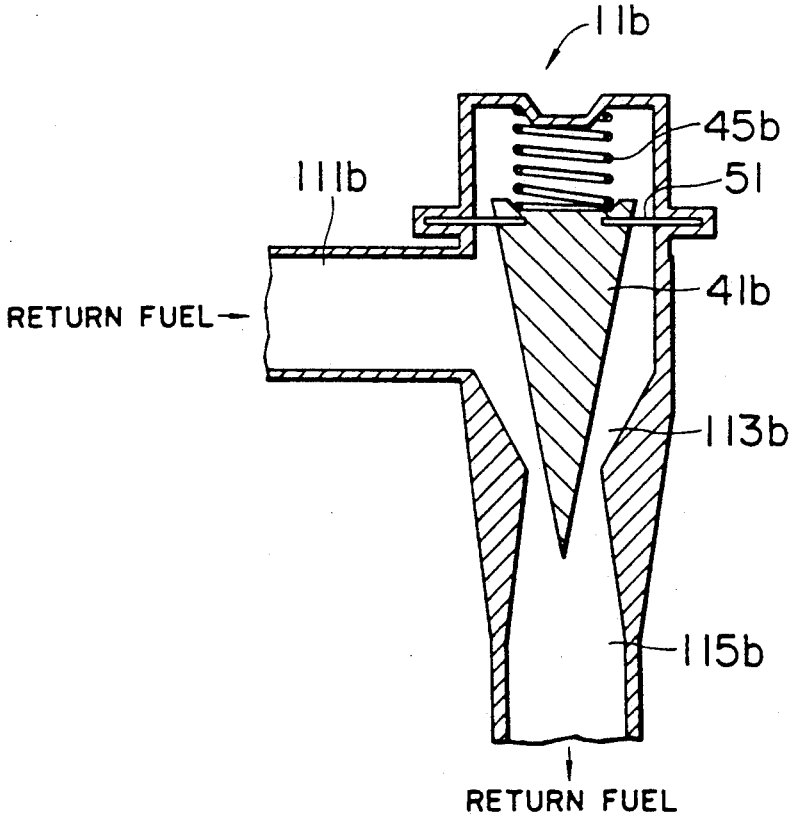
FIG. 6 is a sectional view for illustrating another example of booster the type of which is different from that shown in FIG. 3.

FIGS. 5 and 6 show boosters utilizing the variable choke. A booster 11*a* shown in FIG. 5 comprises an inlet portion 111*a* which is to be connected to the pressure regulator 9 side, a movable core 41*a* facing to the inlet portion 111*a*, a guide pin 43*a* serving to guide the movable core 41*a*, a spring 45*a* for biasing the movable core 41*a* toward the upstream side, and an outlet portion 115*a* which is to be connected to the fuel tank 1 side. A portion where the space between the movable core 41*a* and the passage wall of the inlet portion 11*a* is the narrowest serves as a choke portion 113*a*. Further, the passage area is changed smoothly before and after passing the choke portion 113*a* so that any underchute of fuel pressure does not take place in the booster 11*a* of this type.

Change of the flow rate of return fuel causes the pressure of return fuel to be changed, and however, the movable core 41*a* is moved along the guide pin 43*a* until the product of the pressure of return fuel and the pressure receiving area of the movable core 41*a* on the upstream side of the choke portion 113*a* reaches the set pressure of the spring 45*a*. In this case, not only the pressure receiving area of the movable core 41*a* on the upstream side of the choke portion 113*a* is changed but also the pressure of return fuel is changed in the opposite direction to the first direction of change so as to keep the balance, and therefore, the degree of change in the return fuel pressure becomes smaller as compared with the booster utilizing the fixed choke.

For this reason, it becomes easy to apply the fuel system even to an internal combustion engine in which the return fuel is changed greatly.

Further, another type of booster is shown in FIG. 6. In a booster 11*b* shown in FIG. 6, a movable core 41*b* is so disposed as to face to an outlet portion 115*b* and fitted in a central portion of an annular diaphragm 51. The movable core 41*b* is biased toward the downstream side by means of a spring 45*b*.

A portion where the space between the movable core 41*b* and the wall of the passage adjacent to the inlet portion 111*b* is the narrowest serves as a choke portion 113*b*. The passage area is changed smoothly before and after passing the choke portion 113*b* so that any underchute of fuel pressure does not take place.

Increase of the flow rate of return fuel causes the return fuel pressure to be increased, and however, the movable core 41*b* is moved upwards until the product of the return fuel pressure and the area of the diaphragm 51 reaches the set pressure of the spring 45*b*. In this state of equilibrium, the return fuel pressure is kept constant at all times since the area of the diaphragm 51 is constant. In consequence, in case of using such booster 11*b*, the fuel system becomes applicable to the internal combustion engine in which the amount of return fuel is changed remarkably greatly.

As has been described above, according to the invention, the choke portion 113, 113*a*, 113*b* functions to keep the fuel pressure on the upstream side thereof that ranges from the pressure regulating portion 94 of the pressure regulator 9 to the inlet portion 111, 111*a*, 111*b* higher than the pressure in the fuel tank 1 as well as to make the pressure at the inlet portion 111, 111*a*, 111*b* gradually decrease to the fuel pressure at the outlet portion 115, 115*a*, 115*b* on the downstream side, that is, to the pressure in the fuel tank 1.

Accordingly, since the fuel pressure is prevented from being less than the pressure in the fuel tank 1 even when overshoot takes place in the pressure regulator 9, there is no possibility that the components which are in gas phase essentially are separated due to deaeration, thereby making it possible to prevent generation of fuel vapor from the fuel returned to the fuel tank 1.

Further, since no overshoot takes place in the booster 11, 11*a*, 11*b*, there is no possibility that fuel vapor is generated when reducing the fuel pressure to the pressure in the fuel tank 1.

Description has been made on the embodiments, and however, the present invention is not limited to the above-described embodiments but can be put into practice in various forms. For example, the booster may use other pressure increasing means than the choke so far as it is possible to increase the pressure of return fuel above the pressure in the fuel tank.

What is claimed is:

1. A fuel system of an internal combustion engine comprising:

a fuel tank for storing fuel;

a fuel injection valve disposed on the internal combustion engine;

a fuel supply pipeline connecting between said fuel tank and said fuel injection valve;

a fuel pump for supplying the fuel in said fuel tank to said fuel injection valve through said fuel supply pipeline;

a fuel injection pressure regulator for regulating the fuel injection pressure of said fuel injection valve to a predetermined pressure;

a fuel return pipeline through which surplus fuel from said fuel injection pressure regulator is returned into said fuel tank; and pressure increasing means disposed in said fuel return pipeline for increasing the pressure in said fuel return pipeline above the pressure in said fuel tank so that the fuel pressure as abruptly reduced by said fuel injection pressure regulator is larger than the pressure in said fuel tank, said pressure increasing means comprising a mechanical choke having a cross-sectional area that is gradually reduced in the flow direction of the fuel so as to prevent an abrupt pressure reduction from occurring in said mechanical choke.

2. The fuel system according to claim 1, wherein a minimum cross-sectional area of said choke is set to be larger than a cross-sectional area that allows the pressure in said fuel return pipeline to become equal to the fuel injection set pressure of said fuel injection pressure regulator in order to maintain a fuel injection amount and than a cross-sectional area that allows the pressure in said choke to become equal to the pressure in said fuel tank in order to prevent occurrence of vapor at said choke at the maximum flow rate of return fuel of the internal combustion engine.

3. The fuel system according to claim 1, wherein said pressure increasing means comprises a mechanical variable choke.

4. The fuel system according to claim 3, wherein said mechanical variable choke comprises an inlet portion which is to be connected to said fuel injection pressure regulator side, a movable core facing to said inlet portion, a guide member for guiding said movable core, a spring for biasing said movable core toward said inlet portion, and an outlet portion which is to be connected to said fuel tank side, and wherein a portion where an area of passage defined between said movable core and said inlet portion is the narrowest serves as a choke portion and the passage area is changed smoothly before and after passing said choke portion.

5. The fuel system according to claim 3, wherein said mechanical variable choke comprises an inlet portion which is to be connected to said fuel injection pressure regulator side, an outlet portion which is to be connected to said fuel tank side, a movable core facing to said outlet portion, a spring for biasing said movable core toward said outlet portion, and a diaphragm to which said movable core is connected and which serves to move said movable core away from said outlet portion until the pressure of return fuel flowing from said fuel injection pressure regulator and the set pressure of said spring are balanced, and wherein a portion where an area of passage defined between said movable core and said outlet portion is the narrowest serves as a choke portion and the passage area is changed smoothly before and after passing said choke portion.

* * * * *